United States Patent [19]

Dills

[11] 4,394,565

[45] Jul. 19, 1983

[54] POWER DISCONNECT ASSEMBLY FOR ELECTRIC HEATING ELEMENTS

[75] Inventor: Raymond L. Dills, Louisville, Ky.

[73] Assignee: General Electric Company, Louisville, Ky.

[21] Appl. No.: 324,306

[22] Filed: Nov. 23, 1981

[51] Int. Cl.[3] ..... H05B 3/68

[52] U.S. Cl. ..... 219/452; 219/433; 219/453; 219/463; 219/509

[58] Field of Search ..... 219/262, 266, 331, 434, 219/432, 435, 444, 446, 447, 451, 452, 453, 456, 459, 463, 467, 509, 10.49; 126/37 A

[56] References Cited

U.S. PATENT DOCUMENTS

| | | | |
|---|---|---|---|
| 1,637,155 | 7/1927 | Marsden | 219/452 |
| 2,155,425 | 4/1939 | La Mere | 219/452 X |
| 2,417,223 | 3/1947 | Visitacion | 219/452 X |
| 2,617,005 | 11/1952 | Jorgensen | 219/451 X |
| 3,021,414 | 2/1962 | Sand | 219/455 X |
| 3,025,383 | 3/1963 | Forsness, Jr. | 219/432 X |
| 3,169,517 | 2/1965 | Maier | 219/452 X |
| 3,796,850 | 3/1974 | Moreland et al. | 219/10.49 |
| 4,013,870 | 3/1977 | Summers | 219/451 |
| 4,103,319 | 7/1978 | Crain | 219/331 X |
| 4,129,767 | 12/1978 | Amagami et al. | 219/10.49 |
| 4,164,644 | 8/1979 | Remsnyder et al. | 219/433 |
| 4,214,150 | 7/1980 | Cunningham | 219/452 |

*Primary Examiner*—Volodymyr Y. Mayewsky
*Attorney, Agent, or Firm*—Frederick P. Weidner; Radford M. Reams

[57] ABSTRACT

A power disconnect assembly for a plug-in electric heating element adapted to support and heat a cooking vessel and its contents. The assembly includes a terminal block with terminals for receiving the plug-in heating element and supplying electrical power thereto. A double pole switch with contacts connected to line voltage and to the terminal block is provided and a solenoid is utilized to open and close the double pole switch. Means are provided to detect the presence and absence of a cooking vessel on the heating element and means cooperating with the cooking vessel detection means to deenergize the solenoid in the event of cooking vessel absence and open the double pole switch thus terminating electrical power to the terminal block.

9 Claims, 4 Drawing Figures

POWER DISCONNECT ASSEMBLY FOR ELECTRIC HEATING ELEMENTS

BACKGROUND OF THE INVENTION

This invention relates to a power disconnect assembly for a plug-in electric heating element.

Ranges and cooktops have for years utilized heating elements comprising a metal sheathed electric resistant heater which is wound to flat, spiraled formation with terminal portions connected to a source of electrical power. These heating elements are often plug-in type elements such that they can be manually plugged into a terminal block and unplugged from the terminal block for cleaning purposes or replacement of defective heating elements. Such a plug-in heating element arrangement is disclosed in U.S. Pat. No. 4,013,870.

It has also been known for many years that considerable electrical energy is wasted by reason of the fact that the user of ranges and cooktops often does not immediately turn the control switch to the "off" position after removal of a cooking utensil from the heating element. A number of prior art patents disclose means to detect either the presence or absence of a cooking vessel on a heating element and provide an arrangement for terminating electrical power to the heating element in the event the cooking vessel is absent from the heating element. One such arrangement is disclosed in U.S. Pat. No. 4,214,150. In addition, induction heating cooking units have also utilized cooking vessel detection arrangements again to terminate electrical power to the induction heating unit when a cooking vessel is not present on top of the unit. See, for example, U.S. Pat. No. 3,796,850. Another automatic power termination arrangement is disclosed in U.S. Pat. No. 4,164,644 wherein a portable electric heating unit utilizes a power disconnect assembly.

One of the problems that the prior art has not provided for is an arrangement whereby electric power to the terminal block is prevented in the event the plug-in heating element is removed from the terminal block and the control switch for the heating element is "on". Usually, the plug-in heating element is removed so the user can clean around the area of the heating element and terminal block. It is, therefore, desirable to have no electric power to the terminal block to eliminate any possible electric shock hazard. It is particularly useful to have a power disconnect assembly wherein a solid state control device is utilized to adjust or regulate the power available to the electrical heating element to control the heat output of the unit. Solid state control devices may fail in a short circuit condition and thus make available at the terminal block electrical power in the event the control is in an "on" position and the plug-in heating element has been removed.

By this invention, there is provided an automatic means for disconnecting the electrical power to the terminal block when a plug-in electric heating element is unplugged for the terminal block and also the means disconnects power to the terminal block in the event a cooking vessel is absent from the heating element surface.

SUMMARY OF THE INVENTION

According to one aspect of this invention, there is provided a power disconnect assembly for a plug-in electric heating element adapted to support and heat a cooking vessel and its contents. The assembly includes a terminal block with terminals for receiving the plug-in heating element and supplying electric power thereto. A double pole switch with contacts connecte to line voltage and to the terminal block is provided and a solenoid is utilized to open and close the switch. Means are provided to detect the presence and absence of a cooking vessel on the heating element and means cooperating with the cooking vessel detection means to deenergize the solenoid in the event of cooking vessel absence and open the switch. Thus, with the absence of a cooking vessel on the heating element, all electrical power to the terminal block is terminated.

DESCRIPTION OF THE PREFERRED EMBODIMENT

Figure 1:
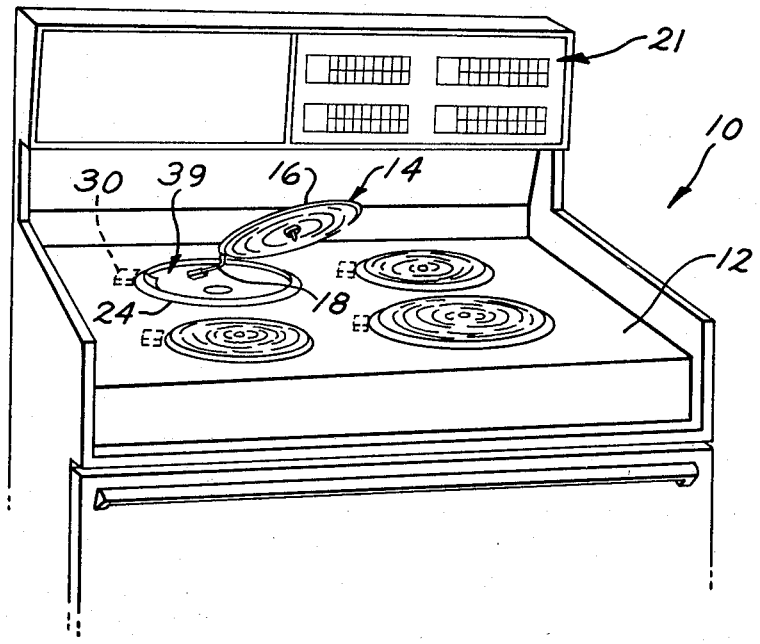
FIG. 1 is a view of a range with a cooktop utilizing plug-in type electric heating elements.

With reference to the drawing, there is shown a range 10 having a cooktop surface 12 with a plurality of plug-in electric heating elements 14 of the usual construction comprising a metal sheathed resistance heater 16 which is wound to a flat, spiral formation and has terminal portions 17 and 18 extending downwardly and outwardly of the spiral. Terminals 17' and 18' extend outwardly of the extremities of the respective terminal portions 17 and 18 and are adapted to connect the heating element 14 to a terminal block 30 for electrical power. Control of the individual heating elements by the user is by a control console 21 having, in the embodiment shown, an array of micro touch selection areas such that the user may select the power level and thus the desired degree of heat for each heating element 14.

Figure 2:
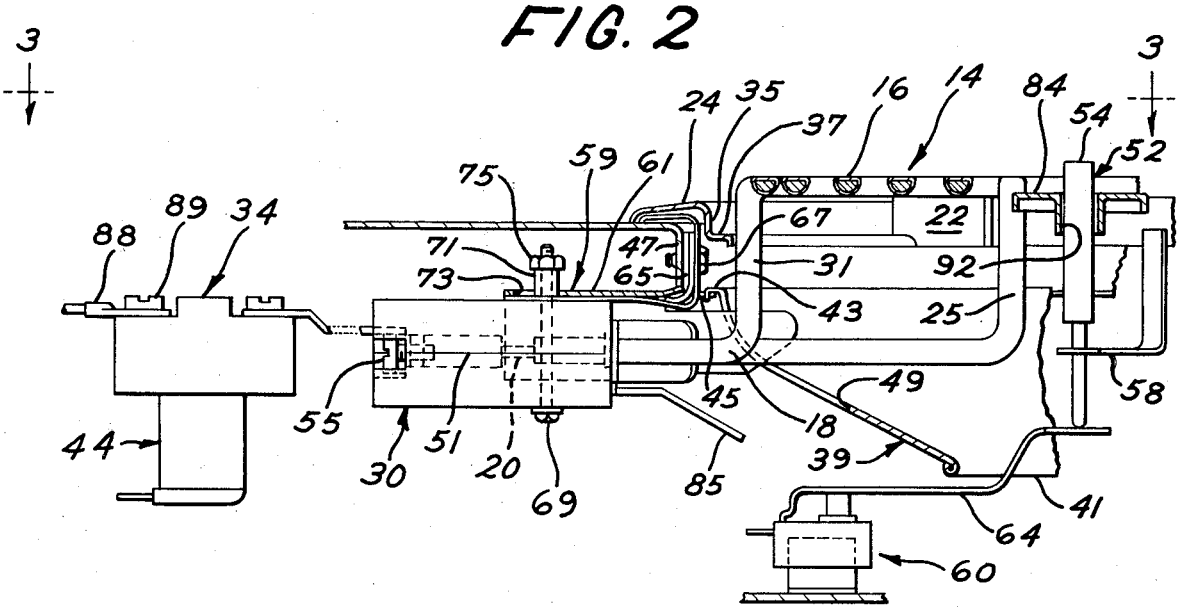
FIG. 2 is a fragmentary cross-sectional elevational view of a plug-in type electric heating element assembly embodying the present invention.
Figure 3:
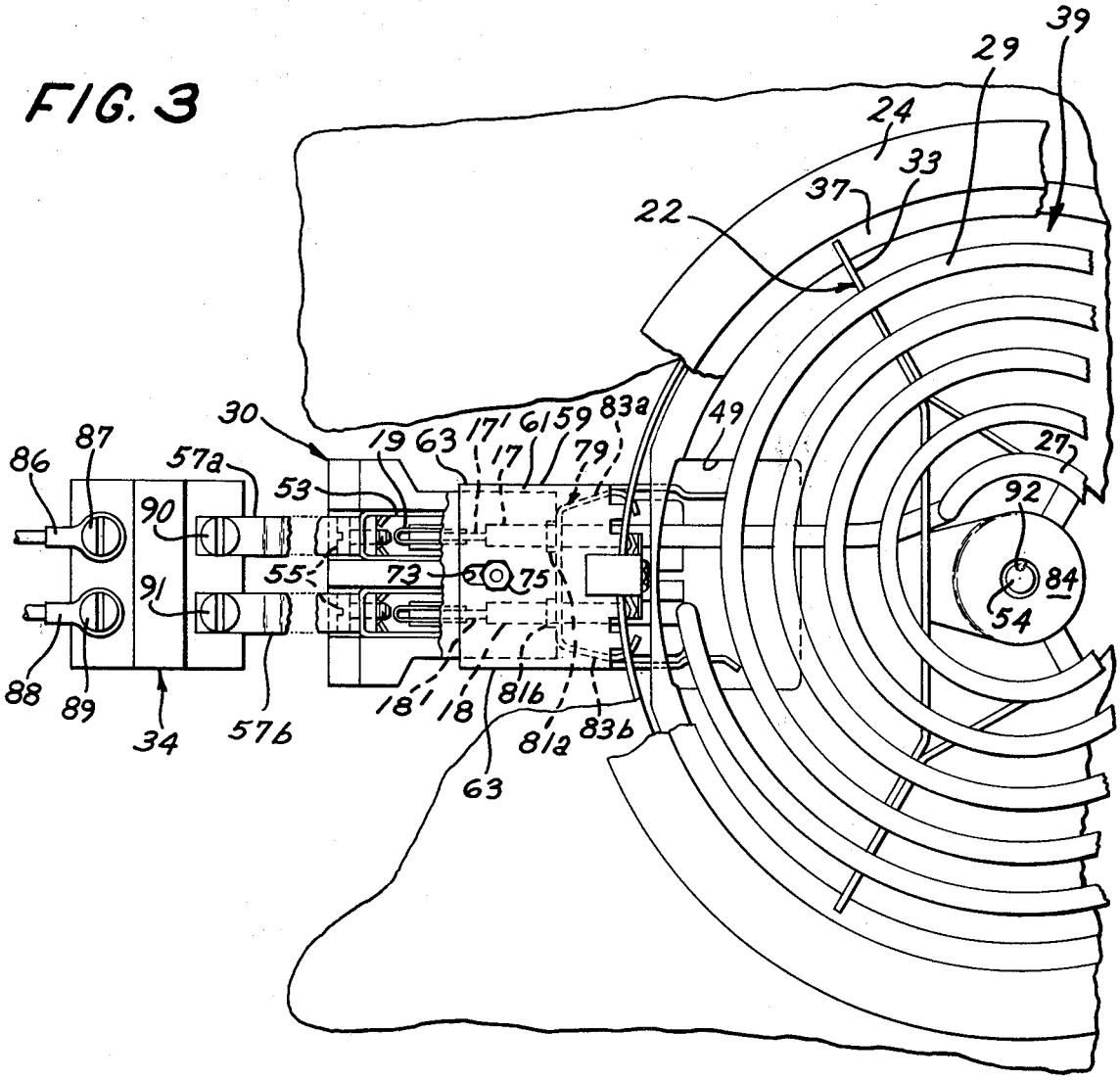
FIG. 3 is a fragmentary top plan view of a plug-in type electric heating element assembly taken along lines 3—3 of FIG. 2.

As seen in FIGS. 2 and 3, each terminal portion 17 and 18 of the heating element 14 has an unheated end that terminates in a terminal wire 17' and 18', respectively, and each terminal wire is provided with a doubled-over spring contact 19 and 20, respectively, the metal sheathed resistance heater 16 extends from the first terminal portion 17 horizontally inward toward the center of the heating element 14, and then rises vertically, as at 25 to the plane of the spiral coil, and it is then wound into the first small diameter coil 27 and then spirals in a gradually increasing radius until it finishes the largest diameter coil 29 which then is turned down vertically, as at 31. The heating element extends horizontally outwardly, as at terminal portion 18 in a generally parallel relationship with the first terminal portion 17.

The spiral coils of the heating element 14 are supported by a triangular framework or spider 22 of vertically disposed metal strips which are fastened together as by spot welding. At each apex of the triangle, there is an outwardly directed radial arm 33 which extends beyond the outermost coil 29 to assist in supporting the heating element. The plug-in type heating element 14 is adapted to be recessed into the cooktop 12, and this is accomplished by forming a circular cutout opening in the cooktop in which the plug-in type heating element 14 is positioned. A decorative trim ring 24 is adapted to overlie the peripheral edge of the opening in the cooktop. The inner peripheral edge 35 of the trim ring is formed downwardly to extend slightly into the cooktop opening, and it is also formed with a lower internal ledge or flange 37 for supporting the tips of the radial arms 33 of the spider 22 of the plug-in type heating element 14.

Positioned beneath the plug-in type heating element 14 is a removable reflector pan 39, which is of dished configuration having a central drain opening 41 and an outwardly directed horizontal flange 43 at its upper edge that is adapted to seat upon a ledge 45 that extends inwardly from a lower edge of a vertical flange 47 that extends downwardly from the peripheral edge of the opening in the cooktop 12. A large notch 49 is formed in the top edge of the reflector pan 39 in the vicinity of the terminal portions 17 and 18 of the heating element 16 of the plug-in type heating element 14 to allow the terminal portions 17 and 18 to extend out through the notch and into cooperation with a terminal block 30.

Terminal block 30 is a generally hollow housing formed of molded ceramic insulating material that is split horizontally into two halves, as as 51, for ease in molding the two parts and for installing vertically arranged spring contacts 53 within separated sockets so as to electrically insulate one contact from the other. Each spring contact 53 is provided with a terminal screw 55 at the back end of the terminal block for making an electrical connection with a lead conductor 57. The doubled-over contacts 19 and 20 of the terminals 17' and 18' respectively are vertically disposed and they are received within the vertically arranged spring contacts 53 of the terminal block 30. Thus, the spring contacts 19 and 20 of the heating element 14 are free to pivot in a vertical plane within the spring contacts 53 of the terminal block 30 so that the terminal block does not prevent the plug-in type heating element 14 from assuming a level position, as shown in FIG. 2.

It is necessary to provide a mechanical support means for the terminal block 30 and this is afforded by a channel-like sheet metal mounting bracket 59 which is of folded construction having a top wall 61 and opposite side walls 63. The mounting bracket 59 does not underlie the terminal block 30, but, in effect, straddles it so that the terminal block may move vertically within the bracket. As best seen in FIG. 2, the mounting bracket 59 has a vertical top flange 65 which is adapted to fit against the inner side of the vertical flange 47 that forms the peripheral edge of the cooktop opening. This flange 65 is a mounting flange and it has a hole for receiving a fastening screw 67 therethrough, which screw is alwo threaded into a suitable opening in the vertical flange 47. Thus, the mounting bracket 59 is rigidly supported from the cooktop.

The two-piece terminal block 30 is held together by a vertical through bolt 69 which is insulated by the block from the electrical current-carrying parts of the block. A short sleeve 71 is slipped over the threaded end of the bolt and this sleeve fits through an elongated slot 73 in the top wall 61 of the mounting bracket 59. Then, a lock nut 75 is threaded onto the bolt 69 and tightened in place. This bolt 69, sleeve 71, and nut 75 serve as a lost-motion fastening means between the terminal block 30 and the mounting bracket 59, so that the terminal block is capable of moving in a vertical direction a limited amount while the mounting bracket remains fixed, so that the plug-in type heating element 14 may be raised about 15 degrees from the horizontal which causes the terminal block 30 to be inclined for ease of withdrawing the terminals from the terminal block.

It is necessary to electrically ground the metal sheathed resistance heater 16 of the heating element 14 with the mounting bracket 59 and through it to the cooktop 12. This is accomplished by providing the terminal portions 17 and 18 with a grounding clip 79 which is best seen in FIG. 3. This clip 79 has a central portion with apertures for receiving terminals 17 and 18 therethrough and the clip is crimped in place as at **81*a* and 81*b*. The opposite sides of the grounding clip 79 are provided with resilient fingers 83*a* and 83*b* which are adapted to bear against the mounting bracket 59. The resilient arms 83*a* and 83*b* make a wiping contact with the mounting bracket whenever the terminals of the heating element are inserted or removed from the terminal block 30. In addition, a lower downwardly inclined ramp 85 extends forwardly of the mounting bracket to assist in guiding the spring contacts 19 and 10 and terminal portions 17 and 18 of the plug-in type heating element 14 into the terminal block 30, which aids the user in inserting the plug-in type heating element 14 into the terminal block 30 as it is somewhat hidden underneath the cooktop 12**.

Figure 4:
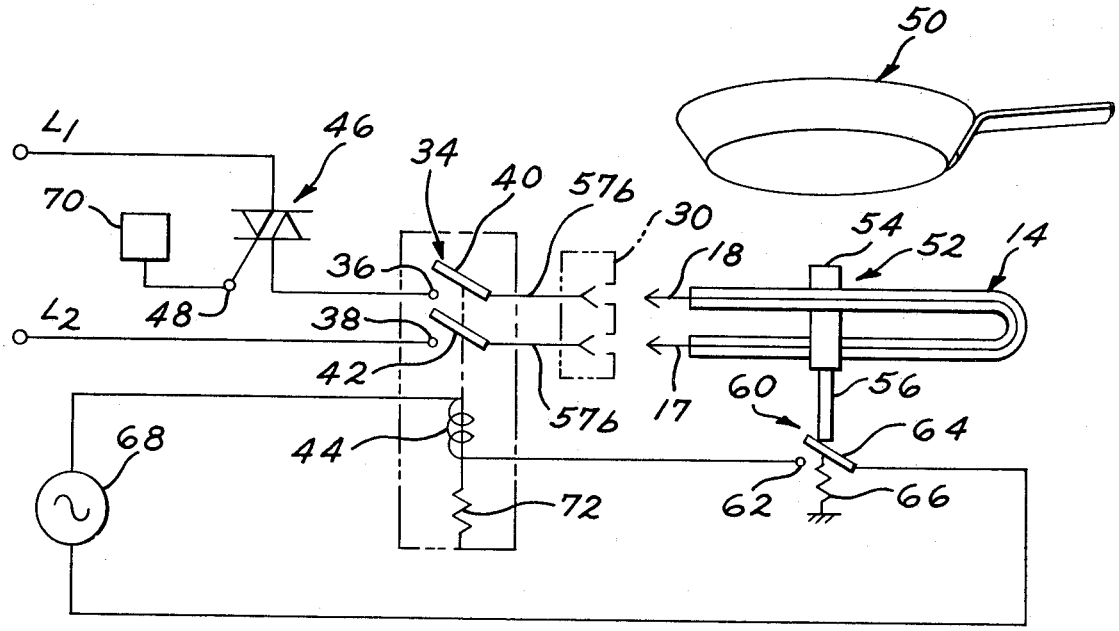
FIG. 4 is a diagramatic representation of one embodiment of the present invention.

Located remote and in a generally inaccessible location to the user is a double pole switch 34 which has two contacts 36 and 38 (FIG. 4) connected to line voltage, namely, L1 and L2, respectively. The contacts 36 and 38 are connected as by terminals 86 and 88 respectively which are attached to the double pole switch 34 by fastening means such as screws 87 and 89 respectively. Lead conductors **57*a* and 57*b* from the terminal block 30 to the double pole switch 34 are connected to switch arms 40 and 42 as by screw fasteners 90 and 91. The switch arms 40 and 42 are gang-connected to a solenoid 44 which controls opening and closing the double pole switch by moving the switch arms 40 and 42 simultaneously in response to operation of the solenoid 44. When solenoid 44 is actuated or energized, electrical connections are made through the double pole switch 34 to provide power from L1 and L2 through lead conductors 57*a* and 57*b* to the terminal block 30**.

Located between a switch contact such as switch contact 36 and line voltage is a solid state control device 46. In the preferred form of the invention, the solid state control device is in the form of a thyristor which is a gate-controlled semiconductor switch which is characterized by its ability to turn "on", that is, switch into conduction when a current signal is applied to the gate-terminal 48 and to turn "off" or commutate "off", that is, to switch into a non-conductive mode when the current through the thyristor drops below a predetermined minimum holding current level. One well-known thyristor device frequently used in phase control application which may be particularly advantageously employed in the control arrangement of the present invention is a triac. The triac is a gate-controlled bidirectionally conducting device in which conduction of current through the device when either load terminal is positive relative to the other can be initiated by the application of a gating signal to the gate terminal 48 of the device 46. Thereafter, the gating terminal loses control over conduction through the device until the current drops below a minimum holding current level by reduction of the applied voltage to zero, and the device turns off.

Thus, in the use of an electronic control for regulating the amount of power available to the plug-in type heating element 14, the triac is used to control that amount of power and thus the heating level of the heating element 14. While it is recognized that such solid state control devices have no moving parts and may operate for long periods of time without failure, there is always the possibility that the solid state control device may fail and when it does, it usually is in a short circuit condition. By this invention, there is provided a means for terminating all electrical power to the terminal block 30 in the event the solid state control device 46 fails in a short circuit condition and the plug-in type heating element 14 is unplugged from the terminal block 30.

The power disconnect assembly of the present invention includes a means to detect the presence and absence of a cooking vessel 50 on the plug-in type heating element 14. There are many prior art arrangements for such detection, however, in the preferred embodiment there is shown a plunger assembly 52 having a top portion 54 disposed for vertical movement within a support 84 having a sleeved opening 92 located at the center of the flat, spiraled resistance heater 16 of the plug-in type heating element 14. Depending from the top portion 54 is a stem 56 which is vertically movable within a guide bracket 58. Underlying the stem 56 is a micro switch 60 having a contact 62 and a switch arm 64 which is biased by a spring member 66 to an open position. When a cooking vessel 50 is placed on the plug-in type heating element 14, it comes into contact with top portion 54 of the plunger assembly 52 and by its weight forces the top portion 54 down to the horizontal plane of the heating element 14 and causes the stem 56 to move downwardly through guide bracket 58 and contact the switch arm 60 overcoming the spring bias force of the spring 66 to thereby close the switch 60 so that switch arm 64 makes contact with contact 62. Electrical power through the switch 60 is provided by any suitable source 68 and said electric source 68 is connected to solenoid 44 through switch 60. In this arrangement, when switch 60 is in its closed condition, thus completing the electrical circuit to the solenoid 44, the solenoid is energized which in turn operates to close the switch 34 and allow electrical power to pass from the electrical contacts 36 and 38 through the switch arms 40 and 42 to terminal block 30 and to the plug-in type heating element 14. In this condition then, the electronic control generally indicated as element 70 in programmed by the user through the control console 21 and may operate in its normal fashion through the solid state control device 46 to control the amount of electrical power to the plug-in type heating element 14 to adjust the heating level desired.

When the cooking vessel 50 is removed from the plug-in type heating element 14, the spring 66 exerts sufficient force on the switch 60 contact arm 64 to disconnect the arm 64 from the electrical contact 62 thus causing the stem 56 and top portion 54 of the plunger assembly 52 to be raised vertically. In so doing, the electrical circuit to the solenoid 44 from the power source 68 is opened and the solenoid 44 is deenergized resulting in the spring bias force of spring 72 opening the switch 34 by removing the switch arms 40 and 42 from the respective contacts 36 and 38. In this manner then, when the cooking vessel 50 is removed from the plug-in type heating element 14, the switch 34 is opened and electrical power is not permitted to pass to the terminal block 30 even if the solid state control device 46 has failed in a short circuit condition. Thus, if the control for the plug-in heating element 14 is left "on" and the plug-in type heating element 14 is removed from the terminal block, there is no possibility of any electrical power being present at the terminal block 30.

The foregoing is a description of the preferred embodiment of the power disconnect assembly for electric heating elements and it should be understood that variations may be made thereto without departing from the true spirit of the invention as defined in the appended claims.

What is claimed is:

1. A power disconnect assembly comprising;

a plug-in electric heating element adapted to support and heat a cooking vessel and its contents, a terminal block with terminals for receiving the plug-in heating element and supplying electric power thereto, a double pole switch with contacts connected to line voltage and to the terminal block, a solenoid to open and close the switch, means to detect the presence and absence of a cooking vessel on the heating element, and means cooperating with the cooking vessel detection means to de-energize the solenoid in the event of cooking vessel absence and open the double pole switch and energize the solenoid in the event the cooking vessel is present and close the double pole switch.

2. The power disconnect assembly of claim 1 wherein the means to detect the presence and absence of a cooking vessel on the heating element is a vertically movably means normally disposed in an upper position above the plane of the heating element when no cooking vessel is supported on the heating element but movable downwardly to a lower position at least within the plane by the weight of a cooking vessel placed on the heating element.

3. The power disconnect assembly of claim 2 wherein the means to de-energize the solenoid and open the double pole switch is responsive to the vertically movable means being disposed in the upper position.

4. The power disconnect assembly of claim 3 wherein the means to de-energize the solenoid and open the double pole switch is a single pole switch that opens when the vertically movable means is disposed in the upper position.

5. The power disconnect assembly of claim 1 wherein a solid state control device for controlling power to the plug-in heating element is located between the double pole switch and line voltage.

6. The power disconnect assembly of claim 5 wherein the solid state control device is a bidirectional triode thyristor.

7. A power disconnect assembly comprising;

a plug-in electric heating element adapted to support and heat a cooking vessel and its contents;

a terminal block with terminals for receiving the plug-in heating element and supplying electric power thereto, a double pole switch with contacts connected to line voltage and to the terminal block, a bidirectional triode thyristor for controlling power to the plug-in electric heating element between the double pole switch contacts and line voltage, a solenoid to open and close the switch, means to detect the presence and absence of a cooking vessel on the heating element including a vertically movable means normally disposed in an upper position above the plane of the heating element when no cooking vessel is supported on the heating element but movable downwardly to a lower position at least within the plane by the weight of a cooking vessel placed on the heating element, and means cooperating with the cooking vessel detection means to de-energize the solenoid in the event of cooking vessel absence and open the switch and energize the solenoid in the event the cooking vessel is present and close the switch.

8. The power disconnect assembly of claim 7 wherein the means to de-energize the solenoid and open the double pole switch is responsive to the vertically movable means being disposed in the upper position.

9. The power disconnect assembly of claim 8 wherein the means to de-energize the solenoid and open the double pole switch is a single pole switch that opens when the vertically movable means is disposed in the upper position.

* * * * *